US008202146B1

(12) United States Patent
Johnson et al.

(10) Patent No.: US 8,202,146 B1
(45) Date of Patent: Jun. 19, 2012

(54) SHOWER STALL VENTILATOR-DRIER

(76) Inventors: Russell Lowell Johnson, Richardson, TX (US); Surinder Amarjit Kang, Richardson, TX (US)

( * ) Notice: Subject to any disclaimer, the term of this patent is extended or adjusted under 35 U.S.C. 154(b) by 1087 days.

(21) Appl. No.: 11/899,669

(22) Filed: Sep. 7, 2007

(51) Int. Cl.
*B01D 35/14* (2006.01)

(52) U.S. Cl. ..... 454/187

(58) Field of Classification Search ..... 454/184, 454/187
See application file for complete search history.

(56) References Cited

U.S. PATENT DOCUMENTS 4,250,917 A 2/1981 Jespersen et al.
4,521,517 A 6/1985 Gauthier
4,594,797 A * 6/1986 Houck, Jr. ..... 34/225
4,685,222 A * 8/1987 Houck, Jr. ..... 34/229
6,176,777 B1 1/2001 Smith et al.
6,207,447 B1 3/2001 Gould
6,375,697 B2 * 4/2002 Davies ..... 55/340

OTHER PUBLICATIONS

Titus Pruducts, Division of Philips Industries, Inc. Catalog T-1013, 1987, p. 65. Model TLQ Plaque Ceiling Diffuser. Richardson, Texas, USA.

* cited by examiner

*Primary Examiner* — Steven B McAllister
*Assistant Examiner* — Samantha Miller

(57) ABSTRACT

A packaged system for selectively (a) exhausting moist air from a shower stall while the shower stall is in use, and (b) drying the ceiling, walls, and floor of the shower stall after use. The system reduces the build-up of mold, mildew, and soap scum in the shower stall, and also reduces excess moisture in the building. A blower moves air through passages opened and closed by dampers driven by an electric damper actuator through a linkage of crank arms and connecting rods. The positioning of the dampers determines the air flow direction, and thereby the operating mode. A control switch starts and stops the system and also selects the damper position. A diffuser, connected to a duct, receives air from the shower stall in the exhaust mode, and alternatively directs drying air from a room air intake onto the surfaces of the shower stall in the drying mode.

2 Claims, 9 Drawing Sheets

Figure 1:
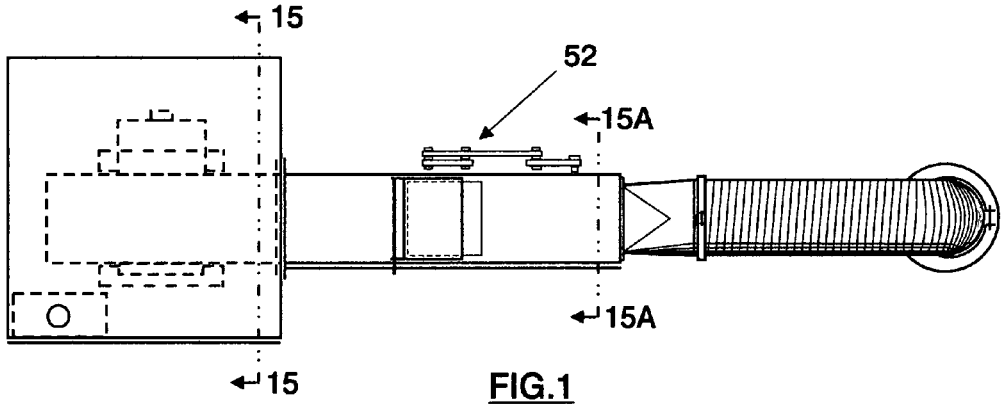

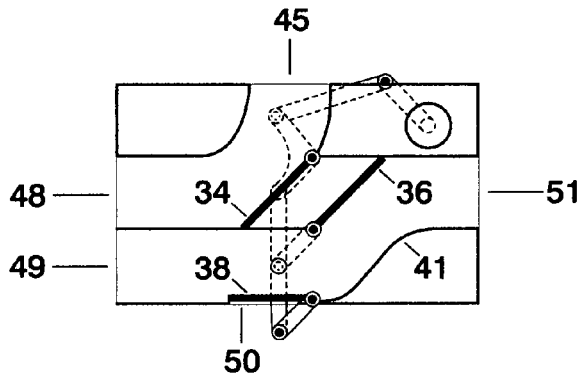
FIG. 3
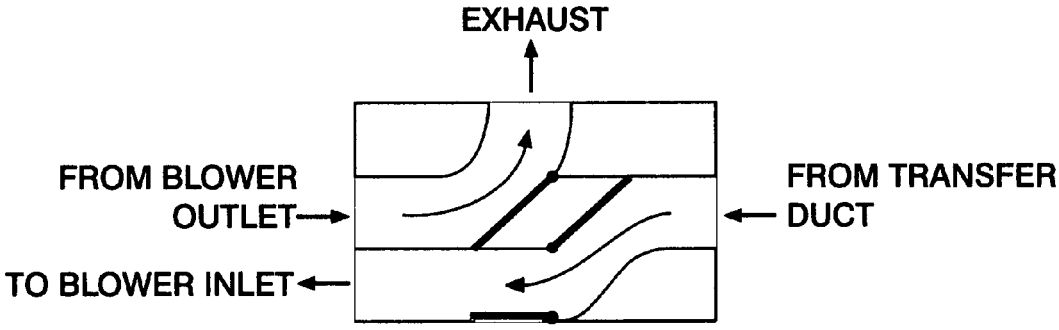
FIG. 4 EXHAUST MODE
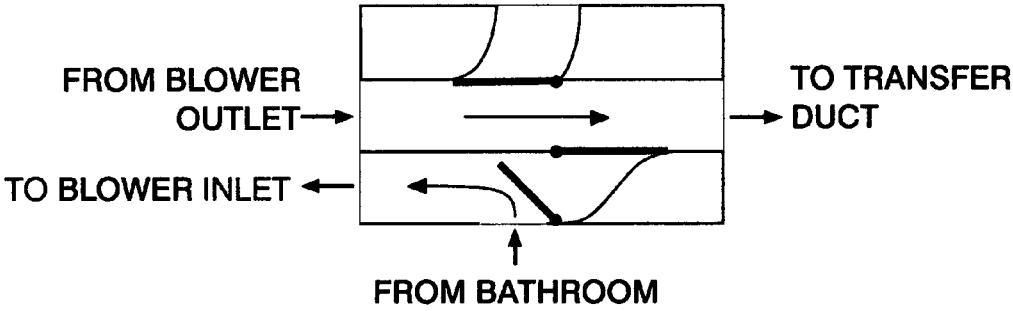
FIG. 5 DRY MODE

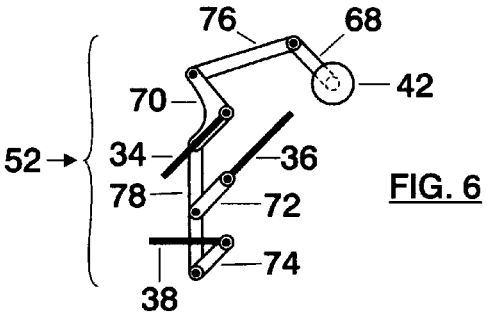
FIG. 6
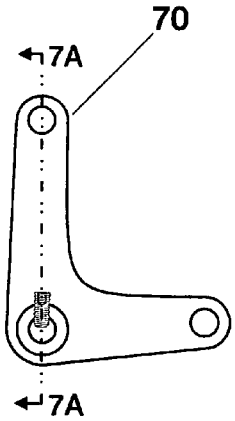
FIG. 7
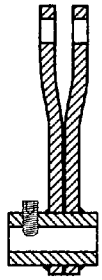
FIG. 7A
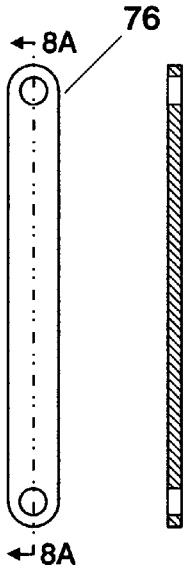
FIG. 8
FIG. 8A
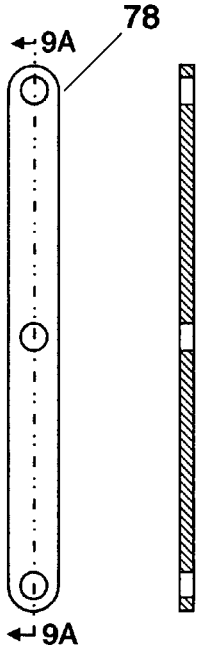
FIG. 9
FIG. 9A
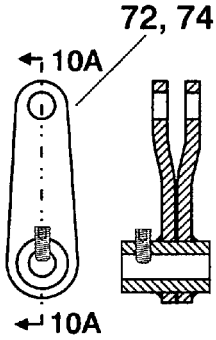
FIG. 10
FIG. 10A
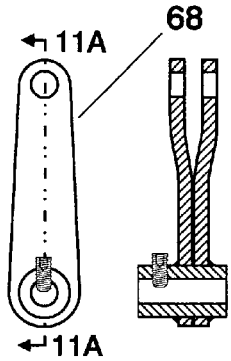
FIG. 11
FIG. 11A
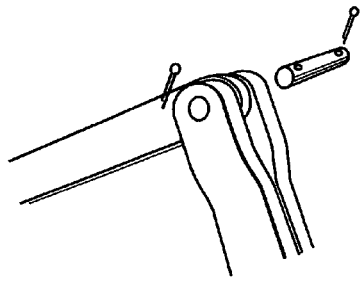
FIG. 12

SHOWER STALL VENTILATOR-DRIER

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISC APPENDIX

Not Applicable

BACKGROUND OF THE INVENTION

1. Field of the Invention

Our invention pertains to the field of mechanical air moving, specifically to the ventilation of enclosed spaces, in this case a shower stall; it also pertains to the drying of surfaces by the action of a flowing layer of air.

2. Prior Art

A shower bath can add considerable heat and moisture to the air in a bathroom and ultimately in the entire building. This can result not only in fogged mirrors and wet walls in the bathroom, but also in a build-up of mold, mildew, and soap scum in the shower stall itself. In addition, the excess moisture in the air increases the latent heat load on the air conditioning system of the building.

This problem can be solved with adequate ventilation and drying. But while bathroom exhaust fans have long been in use, they are generally installed in the bathroom, somewhere outside the shower stall, in order to avoid code restrictions. Thus they do not arrest the warm, moist air before it escapes the shower stall, nor do they directly dry the inside surfaces of the shower stall. A device or system that does perform these functions should exhaust air directly from, and supply drying air directly to, the shower stall—preferrably by a reversal of air flow.

Air flow reversal methods have been proposed. An example is U.S. Pat. No. 4,250,917 to Knud Jesperson et al. (1981) of Canada. This apparatus was designed for processing meat, thousands of pounds at a time, and includes a large, complex enclosure with four dampers and a bank of heating and cooling coils. Another example is U.S. Pat. No. 4,521,517 to L. Paul Gauthier (1985), which is a large array of piping with five widely separated dampers designed for aerating compost piles. There is also U.S. Pat. No. 6,207,447 B1 to Mark Gould (2001), which again is a large system for aerating compost piles, with four dampers and a configuration not suited to a shower stall installation.

Moreover, a system that supplies drying air directly to the shower stall should include an air diffuser that distributes the air over the surfaces of the shower stall evenly, starting with the ceiling and moving downward. Such a diffuser should have a flat physical profile, that is, it should not project too far down from the ceiling. It should have some provision for adapting to various configurations of shower stalls and bathtub enclosures. It should also be attractive, clean looking, yet unobtrusive. Some form of plaque diffuser, (one with a flat air distribution plate) would be ideal for this application.

So far, we have found just one prior art patent relating to a plaque diffuser. This is U.S. Pat. No. 6,176,777 B1 to Smith et al. (2001). This diffuser comprises a square plaque set in a square, surrounding, outer "cone" and surmounted by a square inner cone that is movable for modulating the air flow. Temperature sensors in the air duct and room space send signals to a digital controller, which in turn sends signals to an actuator mechanism that moves the inner cone. This apparatus appears that it would be useful and beneficial for certain sophisticated air conditioning applications, but it is far too complex to be appropriate for a shower stall application.

OBJECTS AND ADVANTAGES

Our shower stall ventilator-drier is a packaged system for installation in the bathroom of a residence, hotel, or other building. Several objects and advantages are:

(a) to provide a packaged system that can be installed either in a building under construction, or in an existing building.

(b) to selectively (1) ventilate a shower stall while the stall is in use, and (2) to dry the ceiling, walls and floor of the stall after use.

(c) to provide a ventilating action that removes vapor from the shower stall directly, before it can escape into the bathroom, thereby preventing the fogging of mirrors and the accumulation of moisture on walls.

(d) to provide general ventilation of the bathroom as well as of the shower stall itself (e) to provide a drying action that removes the film of water from the surfaces of the shower stall after use, partly by evaporation and partly by forcing the water toward the drain, thereby reducing or eliminating the build-up of soap scum, mold and mildew.

(f) to remove moist air from the shower stall before it is circulated throughout the building so as to reduce the latent cooling load on the building's air conditioning system, and also to avoid the adverse effects of excess moisture; on the structure and contents of the building and on the comfort and health of the occupants.

(g) to provide a shower stall ventilating and drying system that is mounted above the bathroom ceiling, in such a way that the electrical components are not positioned over the shower stall, thus avoiding electrical safety concerns and code restrictions.

Further objects and advantages of our invention will become apparent from a consideration of the drawings and ensuing description.

SUMMARY

Our shower stall ventilator-drier is a packaged system for selectively (a) exhausting warm, vapor-laden air from a shower stall and (b) receiving supply air from an adjacent bathroom and injecting that supply air into the shower stall, for the purpose of drying the ceiling, walls and floor of the shower stall. The system comprises a single electrically-driven blower; a set of three dampers; a single electric damper actuator; electrical controls; an enclosure for the blower, dampers, and controls; an air diffuser to be mounted in the shower stall ceiling; and an air transfer duct connecting the enclosure to the diffuser.

DRAWINGS

Figures

FIG. 1. Top view of shower stall ventilator-drier system.

Figure 2:
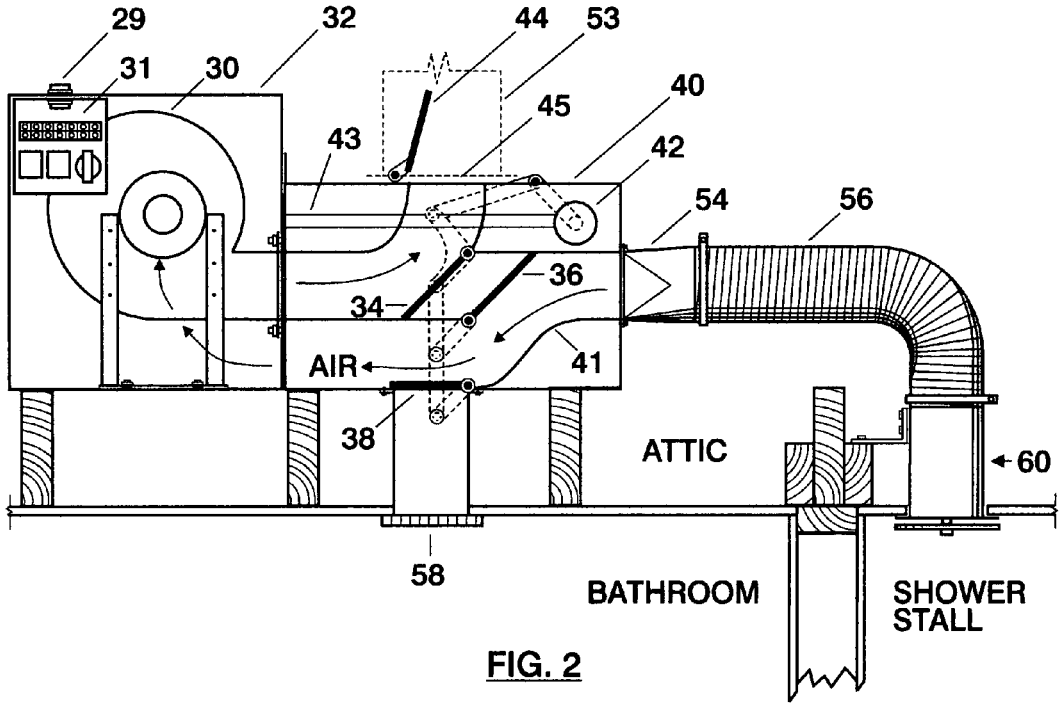

FIG. 2. Side view of shower stall ventilator-drier system, showing installation.

FIG. 3. Damper Box—dampers and ports numbered

FIG. 4. System operation with dampers in EXHAUST position.

FIG. 5. System operation with dampers in DRY position.

FIG. 6. Dampers, actuator, and operating linkage, schematic.

FIG. 7. Master damper crank.

FIG. 7A. Section of master damper crank.

FIG. 8. Actuator-master crank connecting rod.

FIG. 8A. Section of actuator-master crank connecting rod.

FIG. 9. Master crank-follower crank connecting rod.

FIG. 9A. Section of master crank-follower crank connecting rod.

FIG. 10. Follower crank (two required).

FIG. 10A. Section of follower crank.

FIG. 11. Actuator crank.

FIG. 11A. Section of actuator crank.

FIG. 12. Detail of crank, connecting rod, crank pin, and cotter key assembly; typical.

Figure 13:
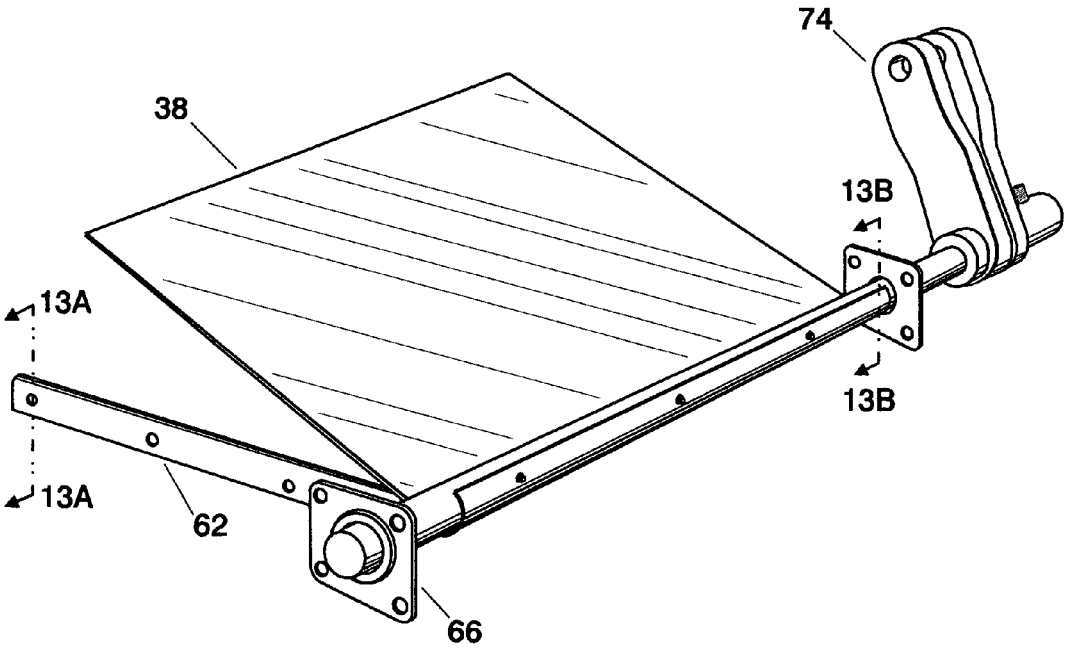

FIG. 13. Damper, shaft, bushings, edge seal, and crank, typical.

Figure 13A:
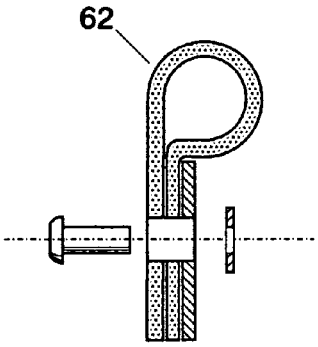

FIG. 13A. Section of edge seal (riveted to casing wall).

Figure 13B:
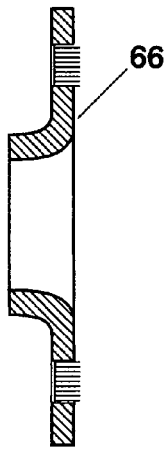

FIG. 13B. Section of bushing (spot welded to casing wall).

Figure 14:
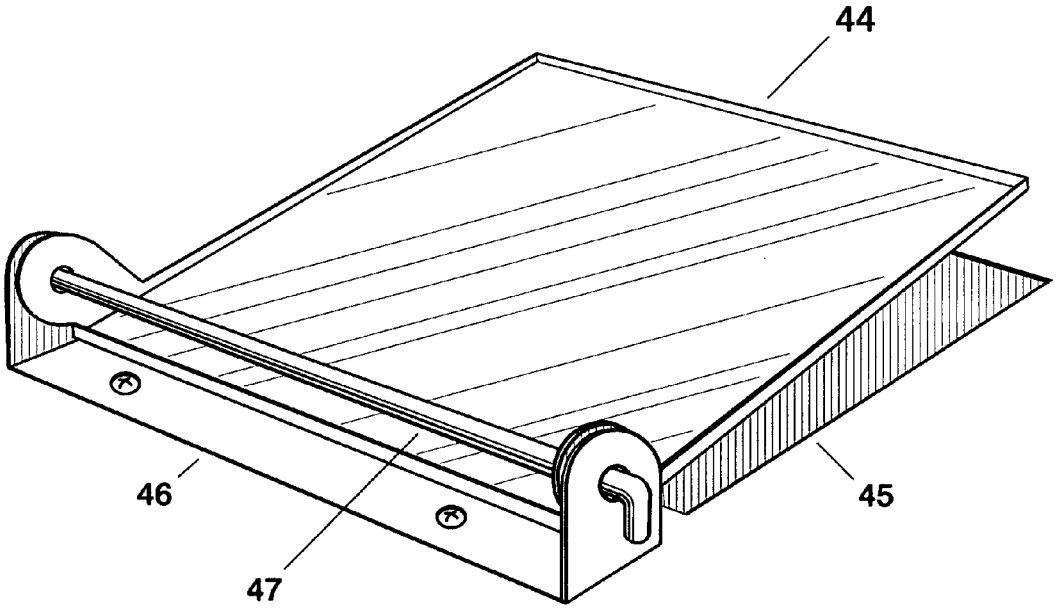

FIG. 14. Back-draft damper assembly.

Figure 15:
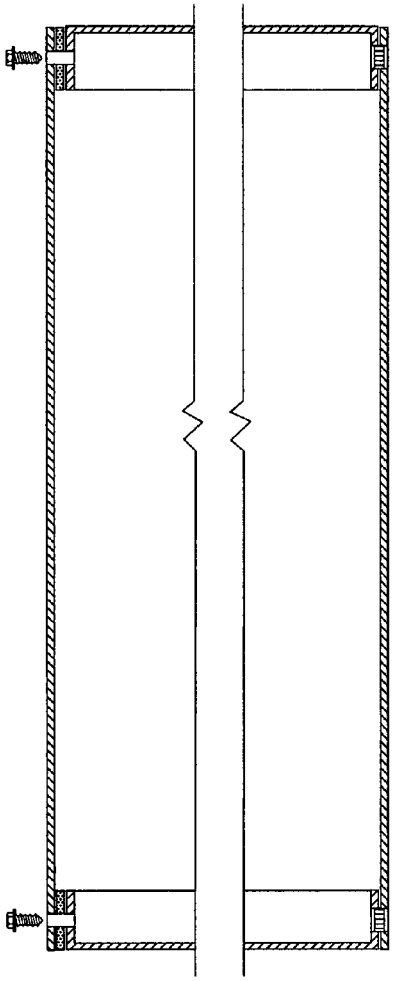

FIG. 15. Section of enclosure, typical.

Figure 16:
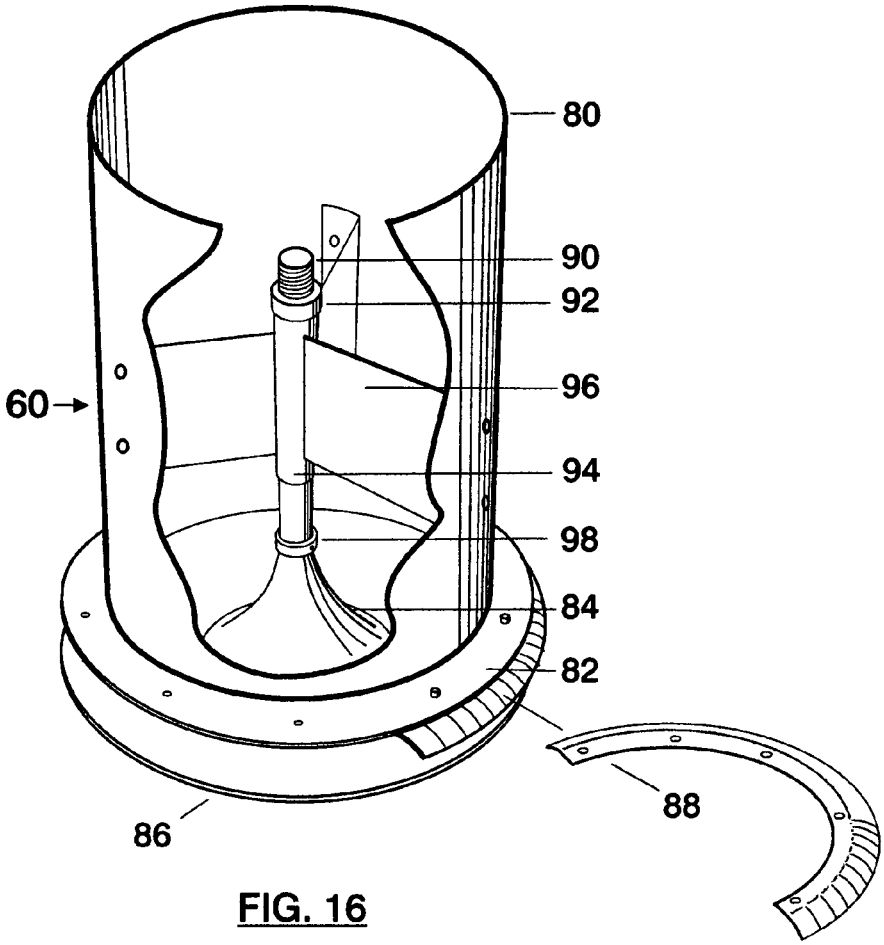

FIG. 16. Shower stall diffuser, cutaway view.

Figure 17:
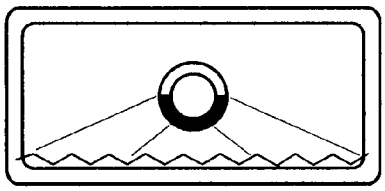

FIG. 17. Deflector positioned to direct air below space above bathtub shower curtain.

Figure 18:
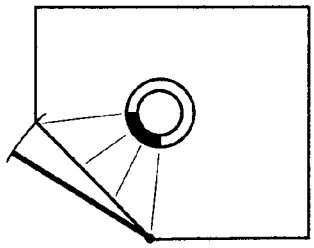

FIG. 18. Deflector cut and positioned to direct air below space above shower stall door.

Figure 19:
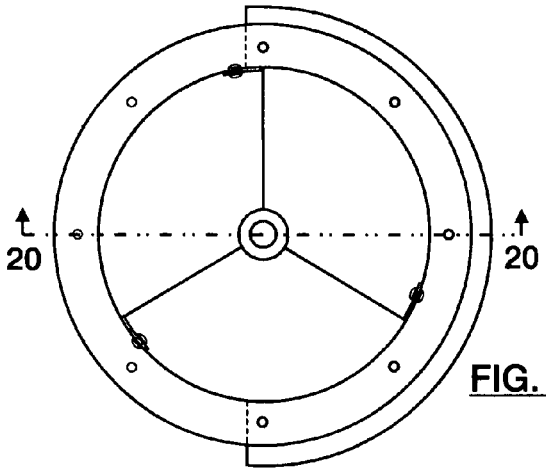

FIG. 19. Shower stall diffuser, top view.

Figure 20:
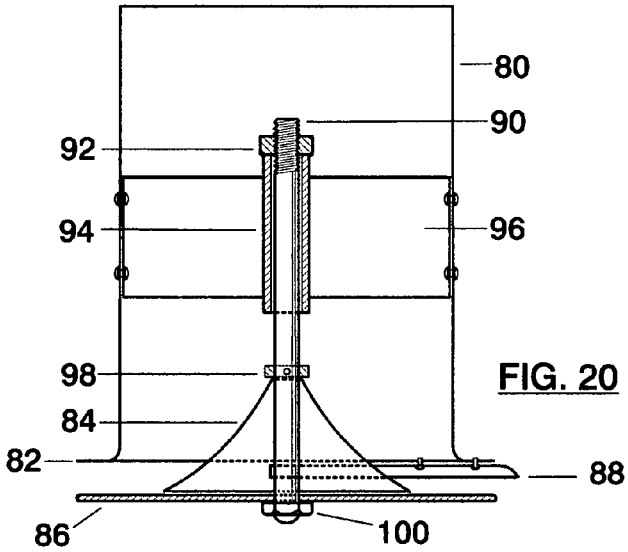

FIG. 20. Longitudinal section of shower stall diffuser.

Figure 21:
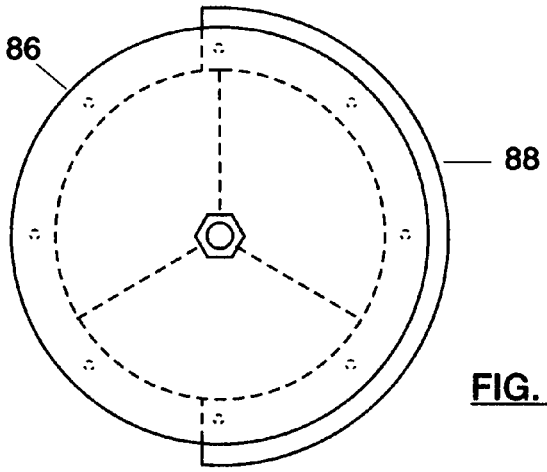

FIG. 21. Shower stall diffuser, bottom view.

Figure 22:
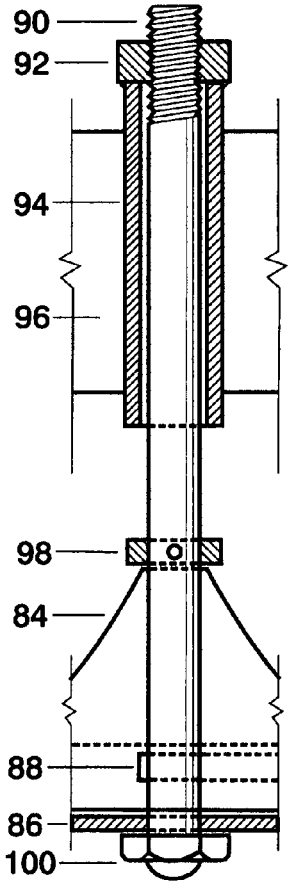

FIG. 22. Enlarged partial view of FIG. 19.

Figure 23:
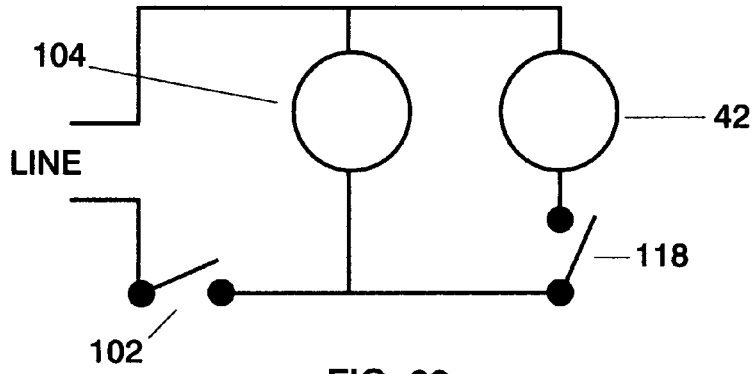

FIG. 23. Wiring and control diagram with two single-pole-single-throw switches and line-voltage controls.

Figure 24:
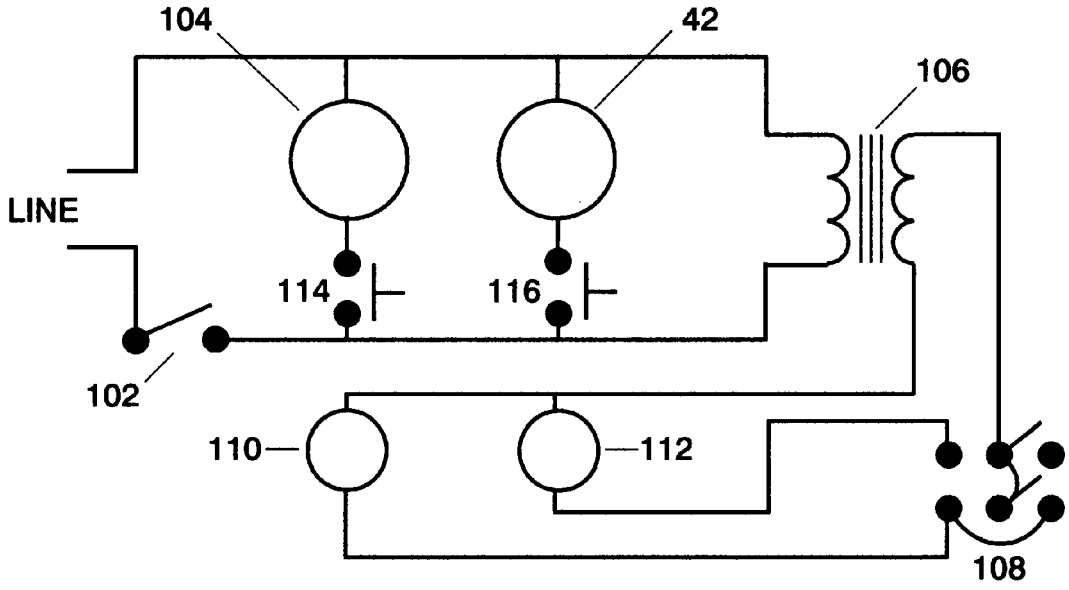

FIG. 24. Wiring and control diagram with one double-pole-double-throw control switch; one single-pole-single-throw, on-off switch; and low-voltage controls.

| DRAWINGS-REFERENCE NUMERALS | |
|---|---|
| 29 | enclosure |
| 30 | blower |
| 31 | control box |
| 32 | blower plenum |
| 34 | damper |
| 36 | damper |
| 38 | damper |
| 40 | damper box |
| 41 | air channel partition |
| 42 | spring-return damper actuator |
| 43 | electrical conduit |
| 44 | back-draft damper |
| 45 | exhaust port |
| 46 | yoke |
| 47 | axle |
| 48 | from-blower-outlet port |
| 49 | to-blower-inlet port |
| 50 | supply air intake port |
| 51 | air transfer port |
| 52 | damper linkage assembly |
| 53 | exhaust stack |
| 54 | transition piece |
| 56 | transfer duct |
| 58 | room air inlet |
| 60 | shower stall diffuser |

-continued

| DRAWINGS-REFERENCE NUMERALS | |
|---|---|
| 62 | edge seal |
| 64 | damper shaft |
| 66 | bushing |
| 68 | actuator crank |
| 70 | master crank |
| 72 | follower crank |
| 74 | follower crank |
| 76 | actuator-master connecting rod |
| 78 | master-follower connecting rod |
| 80 | diffuser body |
| 82 | diffuser ceiling flange |
| 84 | discharge cone |
| 86 | discharge plate |
| 88 | deflector |
| 90 | threaded rod |
| 92 | upper nut |
| 94 | support tube |
| 96 | air straightening vanes |
| 98 | discharge cone collar |
| 100 | acorn nut |
| 102 | on-off switch |
| 104 | blower motor |
| 106 | control transformer |
| 108 | control switch, low voltage |
| 110 | blower motor relay coil |
| 112 | damper actuator relay coil |
| 114 | blower motor relay contacts |
| 116 | damper actuator relay contacts |
| 118 | exhaust-dry switch, line voltage |

DETAILED DESCRIPTION

Preferred Embodiment, FIGS. 1-22, 24

Blower Plenum, FIGS. 1, 2, and 15

As shown in FIGS. 1 and 2, electric-motor-driven centrifugal blower 30 is mounted in blower plenum 32 by means of weld studs projecting from the wall of the plenum through mounting holes in the blower discharge flange, with lock washers and nuts run onto the weld suds. An elastomeric gasket is sandwiched between the discharge flange and the plenum wall. Formed metal support legs attached to the blower housing bear on the plenum floor. The blower is selected for approximately 184 L/s (390 cfm) at 249 Pa (one inch wg) static pressure, input 2.1 amperes at 115 volts, single phase, 60 cps. Control box 31 is also contained in the blower plenum, with the electric line cable connector 29 projecting outside. The control box is covered by the blower plenum cover, alternatively, it can be provided with its own separate cover for quick access. The controls are described below. The blower plenum is formed from sheet steel, galvanized for protection against the moist air that passes through it; its joints are spot welded and its cover is sealed with a foam gasket and held in place with sheet metal screws, as in FIG. 15.

Damper Box, FIGS. 1, 2, 3, and 15

Damper box 40 is formed from galvanized sheet steel with construction similar to that of the blower plenum above. The damper box is attached to the blower plenum by means of flanges that are spot welded to the discharge wall of the blower plenum. Air channel partitions 41 are also formed from galvanized steel with edge tabs that are spot welded to the walls of the damper box. As in the blower plenum, the damper box cover is sealed with a foam gasket wherever it contacts the edges of the damper box walls and air channel partitions. Damper actuator 42 is a spring-return timer motor, 115 volts, single phase, 60 cps, 6 watt input, back-geared to 2 rpm.

As shown in FIG. 5, crank 68 is mounted on the actuator shaft and is connected to connecting rod 76, which in turn is connected to master crank 70. Master crank 70 is mounted on the shaft of damper 34 and is also connected to connecting rod 78. Connecting rod 78 is also connected to follower cranks 72 and 74, which are mounted on the shafts of dampers 36 and 38 respectively.

As shown in FIGS. 7 through 11A, the cranks and connecting rods are made of sheet steel welded or brazed to cylidrical steel hubs. The hubs are drilled and tapped for set screws to secure the hubs to the damper shafts. Each damper shaft has a flat milled on its extension outside the damper box to the hub set screws and to position and anchor the crank. The cranks and connecting rods are joined together with steel pins drilled to receive cotter keys, as in FIG. 12.

Back-Draft Damper, FIGS. 1, 2, and 14

Back-draft damper 44, shown in FIGS. 1, 2 and 14, is made of 28-gauge aluminum, with its blade pivoted at the edge of exhaust port 45 on the top of the damper box. The blade is made light enough that the exhaust air flow raises it easily to its maximum opening position.

Room Air Inlet, FIG. 2

As shown in FIG. 2, room air inlet 58 is a short rectangular galvanized steel duct with a ceiling grille at its lower end and a flange at its upper end for attaching to the bottom of the damper box with sheet metal screws. The lower end of the duct is cut to length at the job site according to the installation conditions.

Discharge Duct, FIGS. 1 and 2

As shown in FIGS. 1 and 2, galvanized steel transition piece 54 is attached by its rectangular flange at the discharge opening of the damper box with sheet metal screws. Its circular downstream end is connected to flexible aluminum duct 56 with a steel hose clamp. The downstream end of duct 56 is clamped to the top of shower stall diffuser 60.

Shower Stall Diffuser, FIGS. 1, 2, and 16-22

As shown in FIGS. 1, 2, and 16 through 22, shower stall diffuser 60 is housed in cylindrical galvanized sheet steel body 80, with ceiling flange 82 at its bottom. Steel support tube 94 is held in place by galvanized sheet steel air straightening vanes 96, which are welded to the support tube and attached to the body with spot welds or sheet metal screws. Upper nut 92 is welded to the upper end of the support tube.

Threaded steel rod 90 runs through the support tube and is screwed into the upper nut. Below the support tube, discharge cone collar 98 is pinned to the threaded rod. Galvanized sheet steel discharge cone 84 is clamped in place between the discharge cone collar and disc-shaped plastic discharge plate 86 by tightening chrome-plated acorn nut 100.

The area of the annular air discharge opening between the ceiling flange and the discharge plate is adjusted by rotating the discharge plate, which is attached to the threaded rod, thereby moving the discharge plate vertically.

As shown in FIGS. 16 and 17, molded plastic deflector 88 is cut and positioned at the job site to suit the configuration of the bath tub or shower stall. The deflector is attached to the diffuser ceiling flange with either sheet metal screws or pop rivets before the discharge plate-discharge cone-threaded rod assembly is screwed in place.

Electrical Controls, FIGS. 1, 2, 23, and 24

Galvanized steel control box 31 is built into blower plenum 32 and is accessible when the blower plenum cover is removed, as in FIG. 2. Alternatively, the control box can be provided with its own separate cover for quick access. It contains the preferred embodiment of the control circuit, that is, the low-voltage version as shown in FIG. 24.

In FIG. 24 the line-voltage house wiring from on-off switch 102 enters the control box through cable connector 29. The primary winding of control transformer 106, also blower motor 104 through relay contacts 114, and damper actuator 42 through relay contacts 116, are connected in parallel to the line voltage house wiring.

The 12 vac secondary winding of transformer 106 is connected through control switch 108 to blower motor and damper actuator relay coils 110 and 112 respectively.

We prefer the low-voltage (12 or 24 volt) control circuit because:

A. Using low-voltage controls to switch line-voltage current to the blower motor and damper actuator requires the use of two small, inexpensive relays, but the relays are an advantage in that blower motor relay 110/114 can be a time-delay relay. This allows blower motor 104 to start just after damper actuator 42 has positioned the dampers. Therefore the damper actuator need not be powerful enough to move the dampers against the air flow, and the damper blades need not be made heavy enough to resist the fluttering that might otherwise occur if they were forced to move against the air flow. Control switch 108 is a small, readily-available toggle switch.

B. Although the above time delay feature could be implemented with a time-delay relay having a line-voltage (115 volt) coil for controlling the blower motor, a double-pole-double-throw control switch suitable for use with line-voltage current, and for mounting in the wall of a residence or commercial building, would be more expensive than, and not as readily available as, the toggle switch in the preferred embodiment.

The preferred embodiment includes a terminal strip mounted inside the control box. This facilitates both the internal wiring and the field wiring connections. The terminal strip is not shown in FIG. 24 because the circuit diagram is schematic, not pictorial.

DETAILS OF CONSTRUCTION

Alternative Embodiment, FIG. 23

In an alternative embodiment, line-voltage controls could be used, as shown in FIG. 23. The electrical circuit is simpler than that of the low-voltage control system; however, for the reasons stated above, it necessitates heavier damper constriction and a more powerful damper actuator than does the preferred low-voltage embodiment.

Construction of the Working Prototype:

For test purposes a working prototype was built, using a design that allowed the use of simple hand tools and commonly available materials. The overall dimensions were 96 cm (37.88 inches) long by 38 cm (15 inches) wide by 53.5 cm (21 inches) high. The blower plenum and damper box were Made of 12.7 mm (one-half inch) plywood protected with urethane spar varnish and a top coat of enamel, glued and screwed together. The curved portions of the air channel partitions were formed from sheet aluminum and attached with wood screws.

The blower plenum and damper box were built as two separate sections, bolted together with flanges made of aluminum angle. The blower support legs were also made of aluminum angle screwed to the floor of the plenum. The back-draft damper was made of 28-gauge sheet aluminum swinging on a steel axle mounted in an aluminum yoke screwed to the top of the damper box.

The control box was an off-the-shelf electrical enclosure mounted externally on the back of the blower plenum.

The gaskets under the blower plenum and damper box covers, and also between the blower plenum and damper box, consisted of adhesive-backed foam weather-stripping tape.

The damper edge seals were cut from extruded aluminum weather strip having tubular synthetic rubber inserts.

Sheet brass was used for the damper blades, which were soldered to brass shafts. The shaft bushings were made by hammering 6.4 mm (one-quarter-inch) brass grommets into sheet brass flanges, which were then screwed to the wall and cover of the damper box. The damper cranks were made of sheet brass and brass tubing soldered together, with brass grommets in their ends to receive brass crank pins.

As in the preferred embodiment above, the blower in the prototype was selected for approximately 184 L/s (390 cfm) at 249 Pa (one inch wg) static pressure, input 2.1 amperes at 115 volts, single phase, 60 cps. The damper actuator selected for the prototype was a spring-return timer motor, 115 volts, single phase, 60 cps, 6 watt input, back-geared to 2 rpm. The controls operated at 12 vac, 60 cps.

The shower stall diffuser was built essentially the same as described in the preferred embodiment above, except that the straightening vanes and other internal parts were made of brass. The brass straightening vanes were isolated from the galvanized body with plastic pads to prevent electrolytic corrosion.

The flexible duct was 152 mm (six inch) diameter spiral aluminum.

Details of Operation, FIGS. 1, 2, 3, 4, 5, 13, 13*a*, 14, 16-24

Exhaust Mode

In FIG. 2, diffuser 60 receives air to be exhausted from the shower stall and directs the air through duct 56 and transition piece 54, then through damper 36 to the inlet of blower 30. The blower then discharges the air through damper 34, back-draft damper 44, and out exhaust stack 54. See also FIG. 4.

Drying Mode

In FIG. 2, air from room air inlet 58 is drawn though damper 38 to the inlet of blower 30, which blows the room air out past dampers 34 and 36, though transition piece 54 and duct 56 and into diffuser 60. See also FIG. 5. Diffuser discharge plate 86 (FIGS. 16, 20-22), directs the room air across the ceiling of the shower stall, down the walls, and across the floor.

As a result of the so-called "Coanda effect," the air adheres to these surfaces as it moves across them, rather than simply bouncing off, so the water is not only evaporated by impingement but is also swept away toward the floor drain.

Deflector 88 (FIGS. 16-22) modifies the discharge air pattern of the diffuser to suit the configuration of the bathtub or shower stall. It is cut and positioned to direct the air below the space above the shower curtain or stall door.

Damper Operation

Because dampers 34, 36 and 38 are two-position in function (rather than continuously variable), electric damper actuator 42 can be of the spring-return type. The damper actuator moves the dampers by means of operating linkage assembly 52. See FIGS. 1 and 6 through 11.

Again, because the dampers are two-position in function, edge seals 62, (FIGS. 13 and 13A), are fixed to the wall and cover of damper box 40, so that the damper blades seat against them only at the end positions of damper travel. It is only at these end positions that leakage around the edges of the damper blades is critical. By using these fixed edge seals instead of seals attached to the edges of the damper blades, friction against the walls and cover of the damper box is eliminated, so as to avoid binding and unnecessary loads on the damper actuator.

Electrical Controls Operation

In the line-voltage version of the electrical controls (FIG. 23), line-voltage house current energizes blower motor 104 when on-off wall switch 102 is closed. With exhaust-dry switch 118 open, spring-return damper actuator 42 is not energized and is in its EXHAUST position. When the exhaust-dry switch is closed, damper actuator 42 is energized to move to the DRY position. When the on-off switch is open, the blower motor stops, the damper actuator is de-energized, returning to the EXHAUST position. Although the damper actuator is of the spring-return type, a return spring has not been found necessary because the combined weight of the dampers and damper linkage returns the actuator to its de-energized (EXHAUST) position.

FIG. 24 shows the low-voltage version of the electrical controls, which is the preferred embodiment for the reasons given previously. Here line-voltage house current energizes the primary winding of control transformer 106 when on-off wall switch 102 is closed. As long as control switch 108 is in the intermediate OFF position, no other components are energized. When the control switch is snapped to the EXHAUST position, blower motor time-delay relay coil 110 is energized, the associated relay contacts 114 close, and blower motor 104 starts after a delay of about two seconds. Damper actuator relay coil 112 is not energized and its associated contacts 116 remain open; damper actuator 42 is not energized, and remains in the EXHAUST position.

When control switch 108 is snapped from EXHAUST through OFF to the DRY position, blower motor time-delay relay coil 110 is first de-energized, then set to be re-energized. The damper actuator relay coil 112 is energized and its associated contacts 116 close immediately, energizing damper actuator 42, which moves the dampers toward the DRY position. After the damper actuator has moved the dampers fully to the DRY position, blower motor time-delay relay contacts 114 close, having been delayed for about two seconds, and blower motor 104 again starts. All operation stops when control switch 108 is returned to the OFF position; the damper actuator is returned to its de-energized (EXHAUST) position by the combined weight of the dampers and damper linkage, as described above. All current to the system is turned off when on-off wall switch 102 is open.

Diffuser Operation

The velocity of the air leaving the diffuser in the drying mode can be adjusted by rotating discharge plate 86, causing it, together with threaded steel rod 90, to travel up or down, thus varying the area of the annular opening between the discharge plate and the ceiling flange.

CONCLUSION, RAMIFICATIONS, AND SCOPE

From the foregoing description the reader will see that the shower stall ventilator-drier embodied in this invention is a compact, readily installable, packaged system that performs a much-needed function in ventilating as well as drying a shower stall (or a bathtub and tub enclosure), and has the following advantages:

- It removes moist air directly from the shower stall before reaching other parts of the building.
- It eliminates fogged mirrors and wet walls in the bathroom.
- It quickly dries the ceiling, walls, and floor of the shower stall.
- It reduces or eliminates the build-up of mold, mildew, and soap scum in the shower stall.
- It reduces the latent cooling load on the building air conditioning system by keeping
- moisture from the shower stall from reaching other parts of the building.

By removing excess moisture from the air in the building, it reduces the susceptibility to what is called, in heating, ventilating, air conditioning, and environmental terminology, "sick building syndrome"—that is, the difficult-no-remove, destructive effects of mold, mildew, corrosion and decay on the building itself, as well as the propagation of airborne diseases and allergic reactions among the building occupants. Our shower stall ventilator-dryer is consistent with the growing concern about indoor air quality (IAQ).

Although the foregoing description contains many specificities, these should not be construed as limiting the scope of the invention, but as merely providing some illustrations of presently-preferred embodiments of the invention. For example, blower plenum 32, damper box 40, and their related enclosure parts could conceivably be made of a molded plastic material; dampers 34, 36, and 38 might be made of aluminum; the crank arms could be castings; the controls could be solid-state electronic, or even pneumatic; the diffuser could be made of aluminum or plastic, or a mix of materials; and the complete packaged system could be manufactured in several sizes and air-handling capacities to meet various building requirements.

Thus the scope of the invention should be determined by the appended claims and their legal equivalents, rather than by the examples given.

We claim:

1. A packaged system for exhausting vapor-laden air from a shower stall; also for injecting, on command, supply air from an adjacent bathroom into said shower stall, for the purpose of drying all exposed surfaces in the shower stall, said system comprising:

A. a single electric-motor-driven blower;

B. a blower plenum, having walls and a removable cover, for enclosing and supporting said blower, and for conducting air into the inlet of said blower;

C. a damper box attached to said blower plenum, having walls and a removable cover, said damper box communicating with the inlet and outlet of said blower;

D. an air diffuser to be mounted in said shower stall, said air diffuser delivering said supply air into, and alternatively receiving said exhaust air out of, said shower stall;

E. an air transfer duct attached to, and communicating with, said damper box on one end and said air diffuser in said shower stall on the opposite end;

F. said damper box fitted with partitions dividing said damper box into two air flow passages for conducting exhaust air from said air transfer duct to said blower plenum, thence from the outlet of said blower to an exhaust port; and alternatively for conducting drying air from a room air intake in said bathroom to said blower plenum, thence from the outlet of said blower to said air transfer duct;

G. a set of three air flow dampers located in the two said air flow passages, each said air flow damper having a blade fixed to its respective shaft, said shaft being rotatably supported in a bushing mounted in one of said walls of said damper box and in another bushing in said cover opposite, one said bushing supporting each end of said shaft, all three said shafts being parallel to each other and extending outside the wall of said damper box that is opposite said cover;

H. said air flow dampers arranged so that in the exhaust mode, the first said air flow damper opens the first said passage from said outlet of said blower to said exhaust port while simultaneously blocking the first said passage to said air transfer duct; the second said air flow damper opens the second said passage from said air transfer duct to said blower plenum, communicating with the inlet of said blower; and the third said air flow damper closes said room air intake;

I. said air flow dampers furthermore arranged so that in the drying mode, the first said air flow damper closes the first said air flow passage to said exhaust port while simultaneously opening the first said air flow passage from said outlet of said blower to said air transfer duct; the second said air flow damper closes the second said air flow passage from said air transfer duct to said blower plenum; and the third said air flow damper opens said room air intake to the second said air flow passage to said blower plenum, communicating with the inlet of said blower;

J. a single electric damper actuator mounted in said damper box and having an output shaft aligned parallel to said shafts of said air flow dampers;

K. a crank arm fixed to said output shaft of said damper actuator;

L. a master crank arm fixed to said shaft of said first air flow damper;

M. follower crank arms fixed to said shafts of said second and third air flow dampers respectively;

N. a connecting rod transmitting motion from said crank arm on said shaft of said damper actuator to said master crank arm on said shaft of said first air flow damper;

O. a second connecting rod transmitting motion from said master crank arm on said shaft of said first air flow damper to said follower crank arms on said shafts of said second and third air flow dampers, respectively;

P. all four said crank arms in a coplanar relationship wherein said crank arms move simultaneously, each through the same angle of rotation as the others;

Q. electrical control devices and circuitry for supplying power to, starting, and stopping said system, as well as for choosing between said exhaust mode and said drying mode;

R. a control box containing said control devices and said circuitry.

2. The packaged system of claim 1, wherein:

A. said exhaust port in said damper box is fitted with an air-flow-operated back-draft damper comprising a sheet metal blade pivotably mounted on one edge over said exhaust port so as to allow said exhaust air to lift said blade and flow out of said exhaust port, and so as to allow said blade to fall closed when said exhaust air stops flowing, thus preventing unwanted inward leakage of air from outside the system;

B. edge seals are provided for reducing air leakage around said air flow damper blades, said edge seals comprising elastomeric strips fixed to said wall of said damper box and to said cover opposite said wall, perpendicular to said damper shafts, at the end-positions of travel of said air flow damper blades;

C. mounting space is provided for an optional exhaust stack connected to said exhaust port and surrounding said back-draft damper, said exhaust stack being suitable for connecting to an exhaust duct;

D. said room air intake comprises a short duct and a grille;

E. said air diffuser comprises:

a. a cylindrical sheet metal body having an outward-turned ceiling flange;

b. a multiplicity of internal air-straightening vanes connected to a central, axially-disposed support tube;

c. a threaded rod traversing the length of said support tube and engaging an upper nut attached to the top of said support tube, so that rotating said threaded rod will result in vertical movement of said threaded rod;

d. a discharge cone, surrounding and fixed to said threaded rod below said support tube and said straightening vanes, for smoothing the flow of said supply air leaving the bottom of said diffuser;

e. a circular discharge plate fixed to said threaded rod below said discharge cone to form an annular, horizontally-disposed discharge passage between said discharge plate and said ceiling flange, so that rotating said discharge plate causes its vertical repositioning, thereby resulting in adjustment of the open area of said annular discharge passage, and consequent adjustment of air flow rate and velocity of said supply air leaving said diffuser;

f. said circular discharge plate sized and shaped so as to direct said supply air in a substantially uniform layer in close adherence to the ceiling of said shower stall;

g. a circularly curved, molded plastic deflector that can be cut to length curvalinearly and positioned on the bottom of said diffuser just above said discharge plate, so as to alter the discharge pattern of said supply air to suit the configuration of said shower stall;

whereby said packaged system removes and eliminates from a building said exhaust air, plus entrained moisture, from said shower stall and, on command, receives said supply air from a source outside said shower stall, such as the adjacent bathroom, so as to dry the ceiling, walls, and floor of said shower stall, thus reducing the latent heat load on a building cooling system and substantially reducing mold, mildew, and the buildup of soap scum in said shower stall.

* * * * *

UNITED STATES PATENT AND TRADEMARK OFFICE

CERTIFICATE OF CORRECTION

PATENT NO. : 8,202,146 B1
APPLICATION NO. : 11/899669
DATED : June 19, 2012
INVENTOR(S) : Kang et al.

It is certified that error appears in the above-identified patent and that said Letters Patent is hereby corrected as shown below:

Title Page, Item (12) "Johnson et al" should read --Kang et al.--.

Title Page, Item (76) Inventors: "Russell Lowell Johnson, Richardson, TX (US); Surinder Amarjit Kang, Richardson, TX (US)"

should read

--Surinder Amarjit Kang, Richardson, TX (US); Russell Lowell Johnson, Richardson, TX (US)--.

Column 3, line 29, below description for FIG. 15, insert:
--FIG. 15A. Section of damper box, enclosure only.--.

Column 4, line 55, "Damper Box, FIGS. 1, 2, 3, and 15" should read --Damper Box, FIGS. 1, 2, 3, 15 and 15A--.

Column 4, lines 56-57, "Damper box 40 is formed from galvanized sheet steel with construction similar to that of the blower plenum above."

should read

Figure 15A:
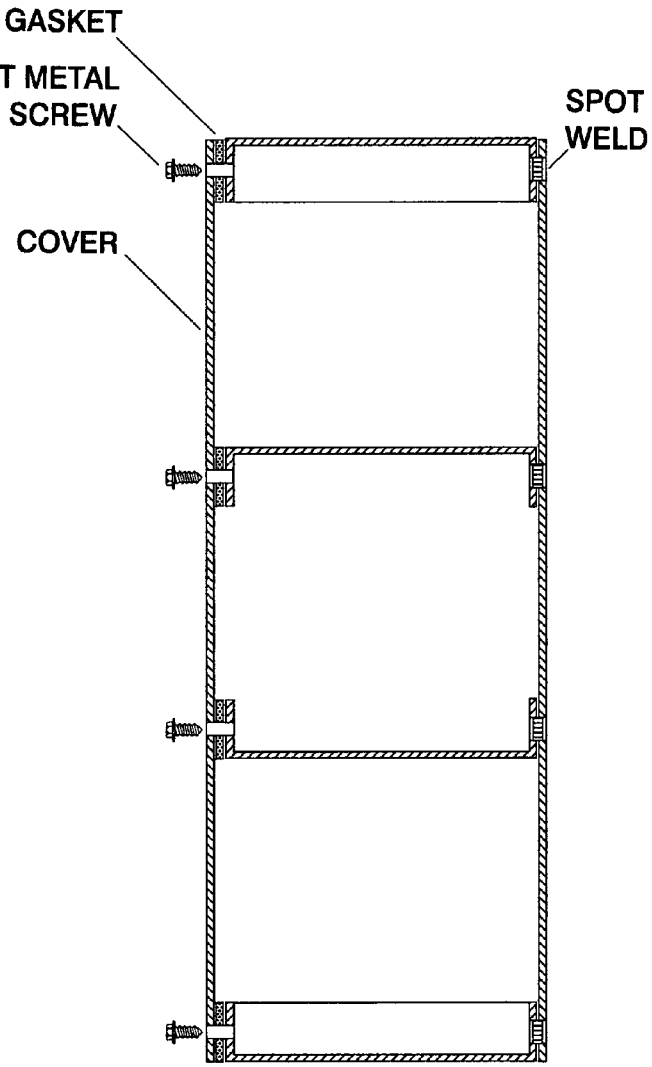

--Damper box 40 is formed from galvanized sheet steel as in FIG. 15A, with construction similar to that of the blower plenum above.--.

Signed and Sealed this
Eighth Day of January, 2013

David J. Kappos

David J. Kappos
*Director of the United States Patent and Trademark Office*